US008074331B2

(12) United States Patent
Voges

(10) Patent No.: US 8,074,331 B2
(45) Date of Patent: Dec. 13, 2011

(54) SLURRY BLASTING APPARATUS FOR REMOVING SCALE FROM SHEET METAL

(75) Inventor: Kevin C. Voges, Shiloh, IL (US)

(73) Assignee: The Material Works, Ltd., Red Bud, IL (US)

( * ) Notice: Subject to any disclaimer, the term of this patent is extended or adjusted under 35 U.S.C. 154(b) by 848 days.

(21) Appl. No.: 12/051,537

(22) Filed: Mar. 19, 2008

(65) Prior Publication Data

US 2008/0182486 A1 Jul. 31, 2008

Related U.S. Application Data

(63) Continuation-in-part of application No. 11/531,907, filed on Sep. 14, 2006, now Pat. No. 7,601,226.

(51) Int. Cl.
*B23K 7/00* (2006.01)

(52) U.S. Cl. ..... 29/81.01; 451/37; 451/38; 451/94; 451/97; 451/98

(58) Field of Classification Search ..... 451/37, 451/38, 94, 95, 97; 29/81.01
See application file for complete search history.

(56) References Cited

U.S. PATENT DOCUMENTS

| | | | | |
|---|---|---|---|---|
| 2,132,311 | A | | 10/1938 | Elwood |
| 2,204,588 | A | | 6/1940 | Guite |
| 2,429,742 | A | | 10/1947 | Barnes |
| 2,777,256 | A | | 1/1957 | Paasche |
| 3,543,775 | A | | 12/1970 | Bodnar |
| 3,731,432 | A | * | 5/1973 | Carpenter et al. ..... 451/89 |
| 3,775,180 | A | | 11/1973 | Hirata et al. |
| 3,832,809 | A | * | 9/1974 | Carpenter et al. ..... 451/39 |
| 3,905,780 | A | | 9/1975 | Jasper et al. |
| 3,984,943 | A | | 10/1976 | Kono et al. |
| 4,251,956 | A | | 2/1981 | Hirata et al. |
| 4,269,052 | A | * | 5/1981 | Imai et al. ..... 72/39 |
| 4,449,331 | A | | 5/1984 | MacMillan |
| 4,561,220 | A | | 12/1985 | Carpenter et al. |
| 4,566,230 | A | * | 1/1986 | Carpenter, Jr. ..... 451/83 |
| 4,723,379 | A | | 2/1988 | MacMillan |
| 4,751,798 | A | | 6/1988 | McDade |
| 4,768,314 | A | | 9/1988 | Thomson |
| 4,907,379 | A | | 3/1990 | MacMillan |
| 5,107,629 | A | | 4/1992 | Boyd et al. |
| 5,386,668 | A | * | 2/1995 | Mugge et al. ..... 451/91 |
| 5,554,235 | A | * | 9/1996 | Noe et al. ..... 148/610 |
| 5,637,029 | A | | 6/1997 | Lehane |

(Continued)

FOREIGN PATENT DOCUMENTS

JP 2007136469 6/2007

(Continued)

OTHER PUBLICATIONS

International Search Report for PCT/US2010/026595 dated May 3, 2010.

(Continued)

*Primary Examiner* — Derris Banks
*Assistant Examiner* — Azm Parvez
(74) *Attorney, Agent, or Firm* — Thompson Coburn LLP

(57) ABSTRACT

An apparatus and method of removing scale from the surfaces of processed sheet metal and tubular metal employs a scale removing medium propelled by counter-rotating pairs of wheels positioned in close proximity to the metal surfaces.

9 Claims, 9 Drawing Sheets

U.S. PATENT DOCUMENTS

| | | | | |
|---|---|---|---|---|
| 6,088,895 | A | 7/2000 | Nelson et al. | |
| 7,077,724 | B1 | 7/2006 | Voges | |
| 7,601,226 | B2 * | 10/2009 | Voges et al. | 134/6 |
| 2005/0116397 | A1 * | 6/2005 | Kimura et al. | 266/135 |
| 2005/0160780 | A1 * | 7/2005 | Kimura et al. | 72/53 |
| 2009/0002686 | A1 | 1/2009 | Voges et al. | |
| 2009/0227184 | A1 * | 9/2009 | Voges et al. | 451/38 |
| 2011/0009034 | A1 * | 1/2011 | Voges et al. | 451/38 |

FOREIGN PATENT DOCUMENTS

| | | | |
|---|---|---|---|
| JP | 2007136469 | A * | 6/2007 |

OTHER PUBLICATIONS

International Search Report for PCT/US2009/037055 dated May 5, 2009.

* cited by examiner

SLURRY BLASTING APPARATUS FOR REMOVING SCALE FROM SHEET METAL

This patent application is a continuation-in-part of patent application Ser. No. 11/531,907, which was filed on Sep. 14, 2006, and is currently pending.

BACKGROUND OF THE INVENTION (1) Field of the Invention

The present invention pertains to a process for removing undesirable surface material from flat materials either in sheet or continuous form, and from narrow tubular material. In particular, the present invention pertains to an apparatus and method for removing scale from the surfaces of processed sheet metal or metal tubing by propelling a scale removing medium, specifically a liquid/particle slurry, against opposite sides of the material passed through the apparatus.

(2) Description of the Related Art

Processed sheet metal is sheet metal that has been prepared for use in making cold rolled sheet metal, and for use in manufacturing some goods. Sheet metal of this type is used in the manufacturing of goods that require a full range of steel thicknesses, for example agricultural equipment, automotive parts, steel containers, and bed frames.

Before sheet metal is used by manufacturers it is typically prepared by a hot rolling process. During the hot rolling process, carbon steel is heated to a temperature in excess of 1,500° F. (815° C.). The heated steel is passed through successive pairs of opposing rollers that reduce the thickness of the steel sheet. Once the hot rolling process is completed, the processed sheet metal or hot rolled steel is reduced in temperature, typically by quenching it in water, oil, or a polymer liquid, all of which are well known in the art. The processed sheet metal is then coiled for convenient storage and transportation to the ultimate user of the processed sheet metal, i.e. the manufacturers of aircraft, automobiles, or home appliances, etc.

During the cooling stages of processing the hot rolled sheet metal, reactions of the sheet metal with oxygen in the air and with the moisture involved in the cooling process can result in the formation of an iron oxide layer, or scale as it is commonly referred to, on the surfaces of the sheet metal. The rate at which the sheet metal is cooled, and the total temperature drop from the hot rolling process effect the amount and composition of the scale that forms on the surface during the cooling process.

In most cases before the sheet metal can be used by the manufacturer, the surface of the sheet metal must be conditioned to provide an appropriate surface for the product being manufactured, so that the sheet metal can be painted or otherwise coated for example. The most common method of removing oxide from the surface of hot rolled or processed sheet metal before coating the sheet metal surfaces is a process known as "pickling." In this process of removing oxide, the sheet metal, already cooled to ambient temperature following the hot rolling process, is uncoiled and pulled through a bath of acid to chemically remove the scale formed on the sheet metal surfaces. Following removal of the scale by the acid bath, the sheet metal is then washed, dried, and immediately "oiled" to protect the surfaces of the sheet metal from oxidation or rust. The oil provides a film layer barrier to air that shields the bare metal surfaces of the sheet metal from exposure to atmospheric air and moisture. It is critical that the sheet metal be oiled immediately after the pickling process, because the bare metal surfaces will begin to oxidize almost immediately when exposed to the atmospheric air and moisture.

The "pickling" process is effective in removing substantially all of the oxide layer or scale from processed sheet metal. However, the "pickling" process has a number of disadvantages. For example, the acid used in the acid bath of the sheet metal is corrosive; it is damaging to equipment, it is hazardous to people, and is an environmentally hazardous chemical which has special storage and disposal restrictions. In addition, the acid bath stage of the process requires a substantial area in the sheet metal processing facility. Furthermore, "pickling" process lines are frequently slowed down by a phenomena called "black edge" forming on portions of the opposite surfaces of the sheet metal along the edges of the sheet metal being pickled. Black edge is difficult to remove by the pickling process.

Thus, there is a need in the industry for an improved apparatus and method for surface conditioning processed sheet metal by removing oxide or scale from the surfaces of the sheet metal, that does not require the manufacturing floor space of the prior art "pickling" process, and does not require the use of a hazardous chemicals such as the acids.

SUMMARY OF THE INVENTION

The present invention overcomes the disadvantages associated with the prior art apparatus and methods employed in removing scale from processed sheet metal by providing a less complex process for removing the scale that does not involve the use of hazardous chemicals. The apparatus of the invention receives previously processed, "i.e. hot rolled" sheet metal and performs the method of the invention to fully remove scale from the sheet metal surfaces. By "sheet metal" what is meant is all forms of sheet metal, for example both strip and sheet materials, of carbon and stainless steels.

The apparatus of the invention may employ a leveler that functions to substantially plane or level the length of sheet metal received from the coil. The leveler could be a tension leveler or a roller leveler, or both.

The length of sheet metal travels from the leveler to a descaler of the apparatus. The descaler includes a plurality of pairs of centrifugal impellers, referred to herein as wheels arranged side by side and spaced above and below the length of sheet metal passing through the descaler. The rotating wheels are supplied with an abrasive scale removing medium, i.e. a liquid and particle slurry. The rotating wheels propel the medium at high speed to the flat surfaces of the length of sheet metal, and the impact of the slurry with the sheet metal removes the scale from the surfaces of the sheet metal as the length of sheet metal passes through the descaler.

The apparatus may optionally also include a brusher or brushing section, following the Voges, U.S. Pat. No. 6,814,815. In most cases there will also be at least one rinsing device that receives the length of sheet metal from the descaler or from the brushing section. The brushing section rotating brushes and rinsing spray impact against the opposite surfaces of the length of sheet metal and assist in the removal of any residual products from the abrasive processing of the descaler. The rotating brushes impacting the opposite surfaces of the sheet metal may also be configured to further condition the surface material or surface texture of the sheet metal surfaces.

The length of sheet metal then passes through a "dryer" that dries or otherwise removes the residual rinsing liquid from the sheet metal.

The dried length of sheet metal could optionally then pass immediately through a coating device, which applies a film of oil, or other protective layer to the dried surfaces of the sheet metal, thereby immediately preventing re-oxidation of the surfaces, and providing lubrication for subsequent processing, and to prevent damage from contact between the two steel surfaces in the coil produced when the dried and oiled length of sheet metal is then passed to a recoiler that winds up the length of sheet metal back into a coil. The descaled and oiled coil of sheet metal is then in a convenient form for storage until needed for subsequent processing.

The full-scale removal process performed by the apparatus of the invention complements other sheet metal processes, for example, the process of the Voges U.S. Pat. No. 6,814,815, which removes a controlled fraction of the scale, leaving a corrosion inhibiting surface suitable for many products that do not require full scale removal, such as some zinc coating operations.

The descaling apparatus and its method provide a novel process of removing scale from processed sheet metal that has several commercial advantages over prior art processes. For example compared to the prior art pickling process, the apparatus and its method of operation have a lower operating cost, at the same time no hazardous materials are needed, and no harmful rinse residues are left on the sheet metal. There is no need to vary the processing line speed or other parameters for removing the more stable oxides formed on the sheet metal strip edges, or on the sheet metal coil ends, where the exposure to air or the longer times at elevated temperature support increased oxidation.

The descaling apparatus can be used in a wide operating window, independent of the sheet metal processing line speed, with there being no equivalent defects in the processed sheet metal caused by line stop stain, rinse stain, or over-pickling of the sheet metal that are historically associated with the pickling process. Small surface blemishes such as slivers and seems are removed using the new process. In pickling the loose steel flap often remains on the strip, covering a section of scale. The flaps come free in subsequent rolling, coating or annealing operations, with increased customer liability for the steel processor. Small pits, small scratches, and small degrees of roller bruises are mitigated by the apparatus.

The descaling apparatus can also be used in combination with a pickling process to remove black edge from sheet metal passed through the pickling process. When used with a pickling process, the pairs of rotating wheels are positioned relative to the sheet metal either entering or exiting the pickling process to propel the scale removing medium toward only portions of the top and bottom surfaces of the sheet that are along the edges of the pickled sheet metal. The impact of the slurry along the black edges of the previously pickled sheet metal removes the stubborn black edges from the opposite surfaces of the sheet metal.

The apparatus and method of the invention also have the potential for one-sided application.

The apparatus of the invention and its method of use can also be used to control the surface texture of the processed sheet metal. The surface texture can be controlled to achieve a target texture using the apparatus of the invention. Texture is a key parameter in higher value added products. Sheet consumers will often specify tight ranges on the Ra and Rpc values for the purchased sheet depending on manufacturing processes and on the end use of the material. A higher Ra value in the 150 micro inch range, may be requested to enhance zinc adherence or coating weight control in medium to heavy coating weight galvanizing lines for example, where a 70 micro inch Ra with high peak count may be requested to enhance the lubrication in drawing or stamping processes, or may be needed to provide an attractive surface after the finish painting.

The apparatus may also be used to achieve different target textures on the opposite surfaces of the sheet metal strip. This is used for instance where an inner surface of a part has a major requirement to carry a heavy coating of lubricant for drawing and then to support a heavy polymer coating for wear and corrosion protection, and the outside surface needs to provide an attractive smooth painted surface. This technique has been used in the past on body panels for luxury automobiles, but would be equally applicable to other applications. The ability to adjust the surface texture of the sheet is important because a rougher surfaced texture normally increases the coating adhesion, but requires more coating. The adjustability feature enables the user of the apparatus to adjust the surface texture for what is more desirable, adhesion or the coating needed.

The apparatus provides a more uniform surface texture than that achievable by pickling the surface of sheet metal which tends to have a mixed topography, particularly in the range of textures referred to as micro-roughness. The apparatus of the invention can be easily adjusted to efficiently accommodate sheet metal strips of different widths. The width of the blast zone in which the slurry contacts the surface of the sheet metal can be reduced for narrower material, but can still essentially use the full design energy of the apparatus wheels, allowing the sheet metal processing line to be operated at higher speeds on narrower materials. The apparatus of the invention could also be used to remove scale from narrow thin strips of materials, for example thin strips of metal that are latter formed into tubing. In this situation, the pairs of rotating wheels of the apparatus would be oriented so that the width of the propelled pattern of the scale removing medium is directed along the length of the narrow strip of material passed between the rotating wheels. As the length of narrow strip material is passed between the pairs of rotating wheels, the impact of the scale removing medium with the narrow strip of material removes scale from the exterior surfaces of the material. Alternatively, the pair of rotating wheels can be adjustably positioned closer to the opposite surfaces of the strip of material so that the widths of the blast zones is just slightly larger than the width of the strip surfaces. In this alternative the speed of the wheels would be decreased slightly to compensate for the increase in the blasting force due to moving the wheels closer to the surfaces.

The use of stainless steel particles in the slurry can improve the corrosion behavior of the sheet metal. This is reportedly due to a reduction in the free iron ions on the surface of the metal, resulting in some surface passivation. The stainless steel particles mixed with the liquid of the slurry will also not corrode. However, the use of stainless steel particles is expensive. For example, stainless steel grit costs approximately $1.70/pound.

A less expensive alternative to stainless steel grit in the slurry is the use of carbon grit in the slurry. Carbon grit costs approximately $0.42/pound. In addition, an additive can be added to the carbon grit slurry to prevent the carbon grit from corroding. An example of such a rust preventative is the Pro-Tech rust preventative produced by the Nalco Company of Naperville, Ill.

An even more inexpensive particle that can be used in the slurry and not corrode is coal slag particles. Coal slag costs approximately $0.015/pound or 1½ cents per pound. One example of an acceptable coal slag particle is provided under the trade name BLACK MAGNUM by Fairmont Minerals of Charldon, Ohio.

When compared to dry blasting sheet metal, the apparatus and method of the invention provides a more consistent performance, because the abrasive particles in the slurry used with the apparatus do not degrade as quickly as do the same or equivalent particles employed in dry blasting. The liquid present in the slurry employed with the apparatus reduces damage caused to the particles of the slurry from incidental, non-targeted impacts between the abrasive particles, which results in a longer useful life of the abrasive particles. Similarly the liquid reduces wear due to contact between the abrasive particles and machine components, which results in a longer useful life of the machine component. Also unlike dry blasting, the apparatus of the invention produces no dust, and thereby provides a more ergonomic work area, reduces the risk of fire, and operates with less noise.

The apparatus of the invention also provides a cleaner strip surface than does dry blasting, which leaves a range of residues on or embedded in the sheet metal surface. These dry blasting residues can include metallic smuts, which are very difficult to remove. In addition, surface contaminants on the sheet metal prior to dry blasting can become embedded in the surface of the sheet metal. Furthermore, unlike dry blasting, wet spots on incoming sheet metal strips do not cause the problem of an agglomeration of loose scale, or wear debris, on the surface of the strip which can result in a further series of defects in the strip. The agglomerated mass could become attached to either the sheet metal strip or to a processing roll in the line.

The problem of dry blasting increasing the temperature in localized areas of the strip which leads to distortion of the strip, and/or flash corrosion of the strip is not experienced in the apparatus of the invention.

The apparatus of the invention can use a wider range of scale removing media, than are practical with dry blasting, for example, a wider range of particle sizes. Different pairs of rotating wheels can be positioned along the length of the sheet metal passed between the pairs of rotating wheels. A larger grit of scale removing medium would be supplied to the first pairs of rotating wheels, and a smaller grit of scale removing medium would be supplied to the second pair of rotating wheels. The larger grit impacting the surfaces of the sheet metal removes the scale from the surfaces of the sheet metal, and the smaller grit impacting the surfaces of the sheet metal generates smoother surfaces on the sheet metal. In a variant embodiment, the initial pairs of rotating wheels are rotated faster than the pairs of rotating wheels further downstream along the length of the sheet metal. The faster rotating wheels propel the scale removing medium to impact with the surfaces of the sheet metal at a greater force to remove the scale from the sheet metal. The slower rotating wheels propel the scale removing medium toward the surface of the sheet metal to impact with a lesser force that generates smoother surfaces on the sheet metal. The apparatus of the invention also increases sheet metal processing options. For example, the slurry can treat the surfaces of the sheet metal with a rust inhibitor used as the liquid in the slurry. A cleaner could also be added to the liquid of the slurry to degrease or clean the surfaces of the sheet metal, allowing reprocessing of defective material produced in other processes.

Compared to other slurry blasting devices, the apparatus of the invention provides a more uniform distribution of the abrasive across the sheet metal width. In the preferred embodiment, each flow stream of slurry propelled by each wheel of the apparatus covers the entire width of the sheet metal.

The apparatus of the invention is also easily adjusted to accommodate different widths of sheet metal. The apparatus has the ability to use its full energy over a wide range of sheet metal widths. In addition, the apparatus can be adjusted so that the pairs of wheels rotate about axes that are substantially perpendicular to the length of the material being treated, for example a narrow thin strip of metal. The widths of the patterns of the scale removing medium propelled from the pairs of rotating wheels is sprayed along the length of the strip on opposite sides of the strip.

The apparatus is more efficient than air injection slurry blasting systems in energy consumption. The air injection systems have to use multiple discharge nozzles to cover a normal industrial strip width. With the current invention there are no discontinuities where the edges of a slurry blasting pattern of an individual flow contacts the sheet metal, and no discontinuities where individual patterns overlap, or where they begin and end.

The centrifugal impeller strip descaling apparatus of the invention also has less component parts when compared to the other slurry blasting devices. The complexity of most of the individual components of the apparatus is also reduced from that of alternative slurry blasting devices. Furthermore, the relative surface area of the components in contact with moving abrasive, for systems with equivalent total volume flow of slurry is much lower in the configuration of the invention when compared to other slurry blasting devices—resulting in lower overall wear.

BRIEF DESCRIPTION OF THE DRAWINGS

Further features of the apparatus and method of the invention are set forth in the following detailed description of the invention and in the drawing figures.

DETAILED DESCRIPTION OF THE PREFERRED EMBODIMENT

Figure 1:
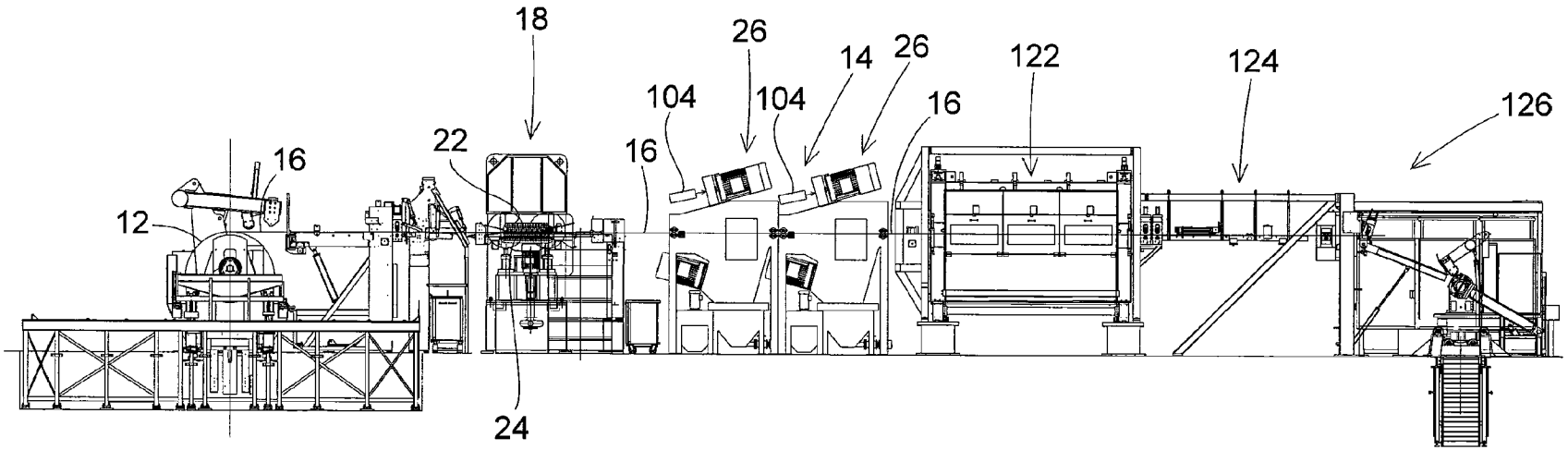
FIG. 1 is a schematic representation of a side elevation view of the processed sheet metal descaling apparatus of the invention and its method of operation.

FIG. 1 shows a schematic representation of the apparatus of the invention that is used to perform the method of the invention in removing scale from the surfaces of processed sheet metal. As will be explained, the sheet metal moves in a downstream direction from left to right through the apparatus shown in FIG. 1. The component parts of the apparatus to be described and shown in FIG. 1 are the preferred embodiment of the invention. It should be understood that variations and modifications could be made to the preferred embodiment to be described without departing from the intended scope of protection provided by the claims of the application.

Referring to FIG. 1, a coil of previously processed sheet metal (for example hot rolled sheet metal) 12 is positioned adjacent the apparatus 14 for supplying a length of sheet metal 16 to the apparatus. The coil of sheet metal 12 may be supported on any conventional device that functions to selectively uncoil the length of sheet metal 16 from the roll 12 in a controlled manner. Alternatively, the sheet metal could be supplied to the apparatus as individual sheets.

A leveler 18 of the apparatus 14 is positioned adjacent the sheet metal coil 12 to receive the length of sheet metal 16 uncoiled from the roll. The Leveler 18 is comprised of a plurality of spaced rolls 22, 24. Although the a roller leveler is shown in the drawing figures, other types of levelers may be employed in the apparatus and process of the invention.

Figure 2:
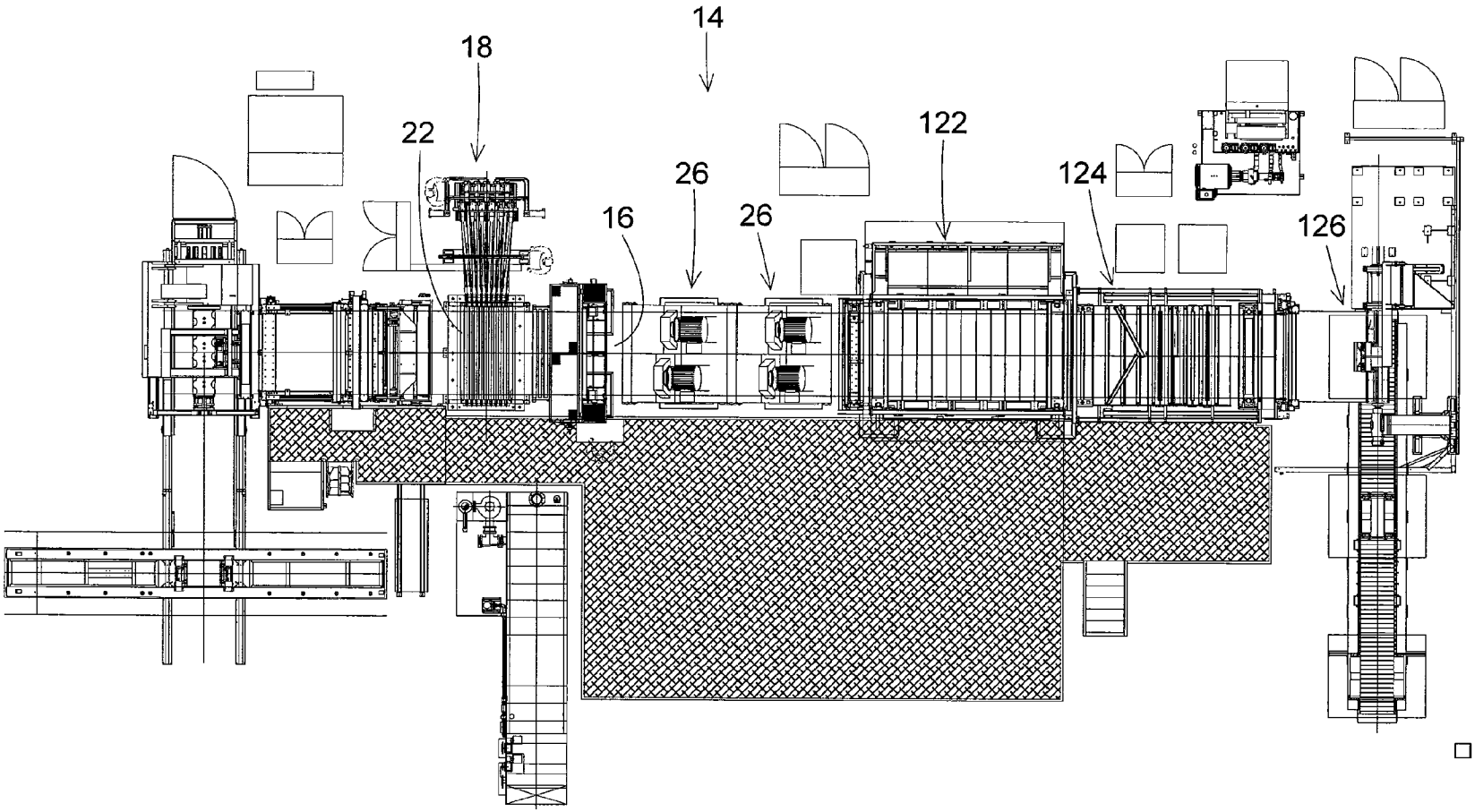
FIG. 2 is a schematic representation of a plan view of the apparatus of FIG. 1.

From the leveler 18, the length of processed sheet metal 16 passes into the descaler 26 of the invention. In FIGS. 1 and 2, a pair of descaler cells 26, consisting of two matched pairs of centrifugal impeller systems, with one pair being installed to process each of the two flat surfaces of the strip are shown sequentially arranged along the downstream direction of movement of the sheet metal 16. Both of the descaler cells 26 are constructed in the same manner, and therefore only one descaler cell 26 will be described in detail. The number of descaler cells is chosen to match the desired line speed of the apparatus, and ensuring adequate removal of scale and subsequent adjustment of surface texture.

Figure 3:
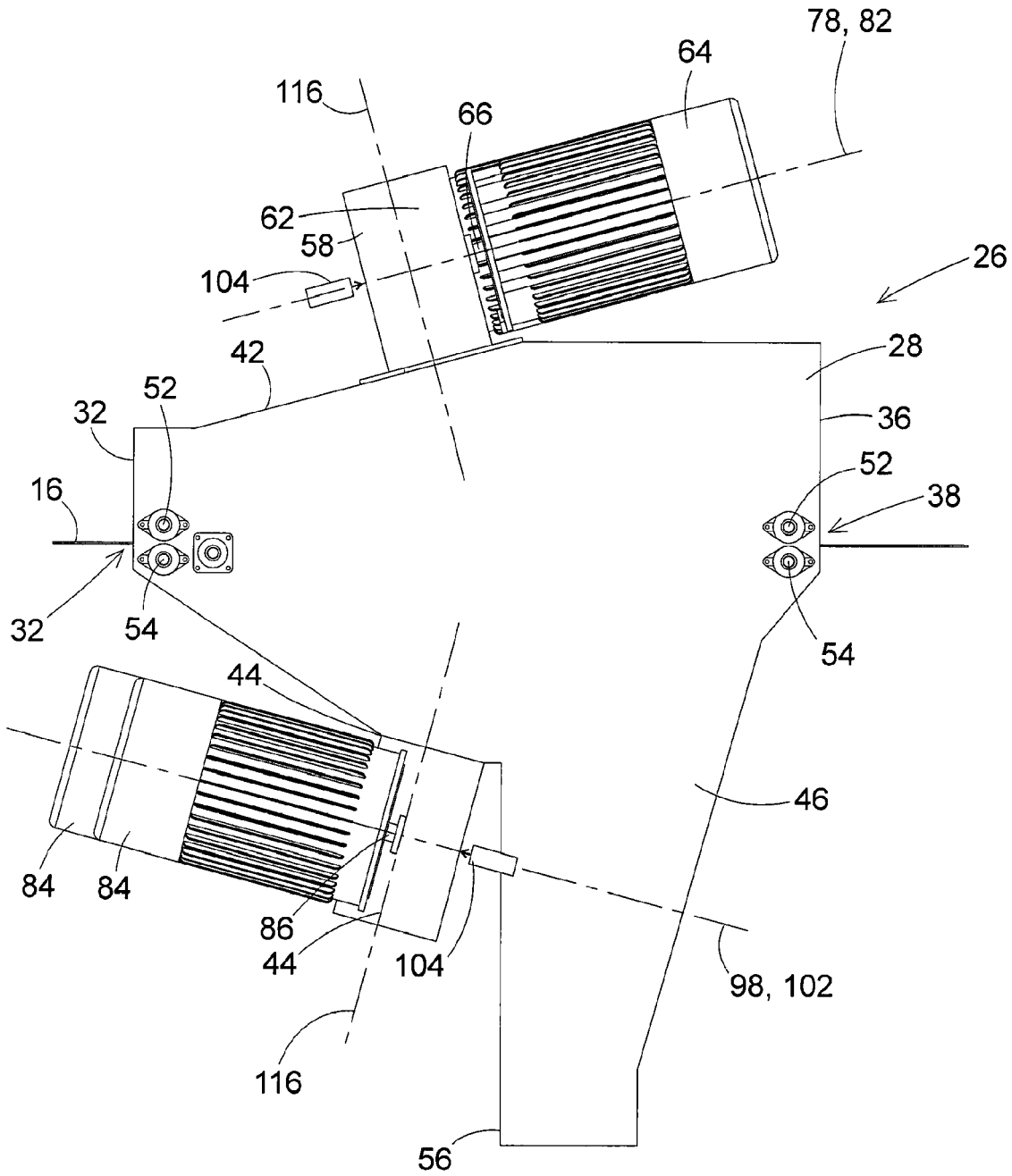
FIG. 3 is a side elevation view of a descaler of the apparatus of FIG. 1.

FIG. 3 shows an enlarged side elevation view of a descaler 26 removed from the apparatus shown in FIGS. 1 and 2. In FIG. 3, the downstream direction of travel of the length of sheet metal is from left to right. The descaler 26 is basically comprised of a hollow box 28. A portion of the length of sheet metal 16 is shown passing through the descaler box 28 in FIGS. 3-5. The length of sheet metal 16 is shown oriented in a generally horizontal orientation as it passes through the descaler box 28. It should be understood that the horizontal orientation of the sheet metal 16 shown in the drawing figures is not necessary for proper operation of the invention. The sheet metal could also be oriented vertically, or at any other orientation as it passes through the descaler apparatus. Therefore, terms such as "top" and "bottom," "above" and "below," and "upper" and "lower" should not be interpreted as limiting the orientation of the apparatus or the orientation of the length of sheet metal for proper operation of the apparatus.

Figure 4:
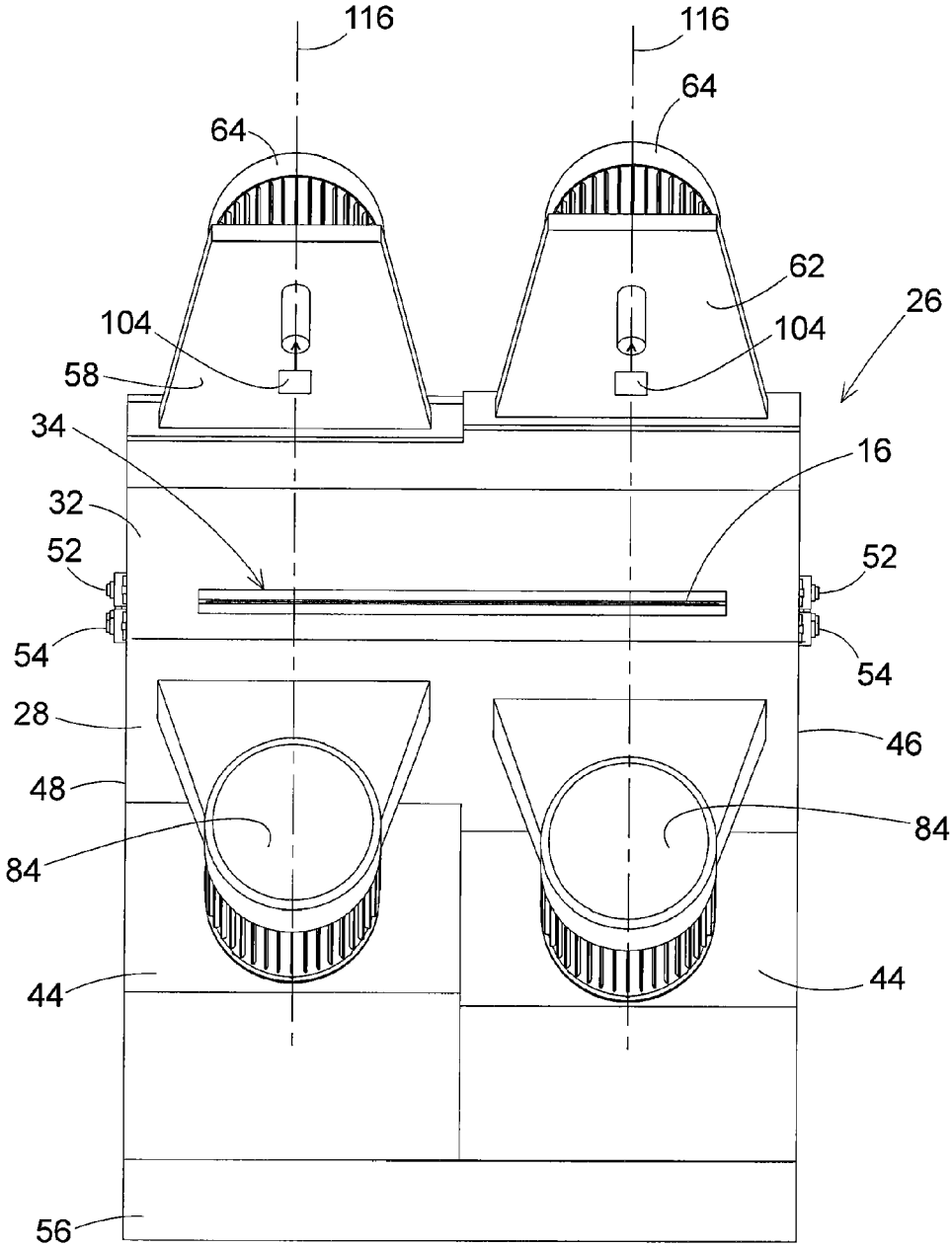
FIG. 4 is an end elevation view of the descaler from an upstream end of the descaler.
Figure 5:
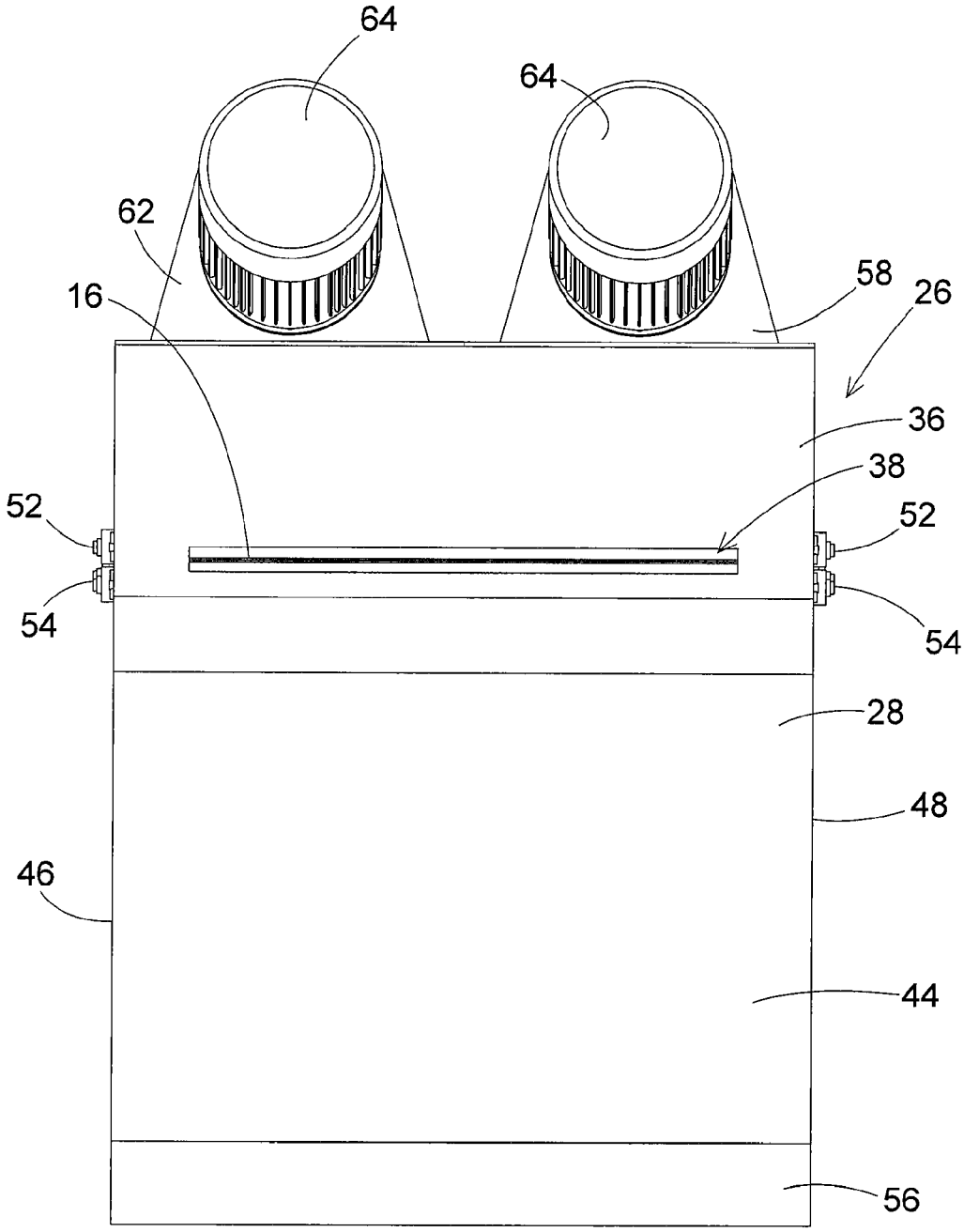
FIG. 5 is an end elevation view of the descaler from the downstream end of the descaler.

An upstream end wall 32 of the box has a narrow entrance opening slot 34 to receive the width and thickness of the length of sheet metal 16. An opposite downstream end wall 36 of the box has a narrow slot exit opening 38 that is also dimensioned to receive the width and thickness of the length of sheet metal 16. The entrance opening 34 is shown in FIG. 4, and the exit opening 38 is shown in FIG. 5. The openings are equipped with sealing devices engineered to contain the slurry within the box during the processing of the strip. The descaler box 28 also has a top wall 42, a series of bottom wall panels 44, and a pair of side walls 46, 48 that enclose the interior volume of the box. For clarity the interior of the box 28 is basically left open, except for pairs of opposed rollers 52, 54 that support the length of sheet metal 16 as the length of sheet metal passes through the box interior from the entrance opening 34 to the exit opening 38. In many cases there will be retracting support devices to assist in threading the ends of strips through the machine. The bottom of the box 28 is formed with a discharge chute 56 having a discharge opening to the interior of the box. The discharge chute 56 allows the discharge of material removed from the length of sheet metal 16 and the collection of used slurry from the interior of the box 28.

A pair of driven centrifugal impellers, 68 are installed in lined casings, shrouds or cowlings 58, 62 which are mounted to the box top wall 42. The shrouds 58, 62 have hollow interiors that communicate through openings in the box top wall 42 with the interior of the box.

As shown in the drawing FIGS. 3-5, the slurry impeller casing shrouds 58, 62 are not positioned side by side, but are positioned on the box top wall 42 in a staggered arrangement. This is done to ensure that the slurry discharging from one impeller does not interfere with the slurry from the other impeller of the pair.

A pair of electric motors 64 is mounted on the pair of shrouds 58, 62. Each of the electric motors 64 has an output shaft 66 that extends through a wall of its associated shroud 58, 62 and into the interior of the shroud. Descaling wheels 68 are mounted on each of the shafts 66 in the shrouds. The descaling wheels and their associated shrouds are similar in construction and operation to the slurry discharge heads disclosed in the MacMillan U.S. Pat. Nos. 4,449,331, 4,907,379, and 4,723,379; Carpenter et al. U.S. Pat. No. 4,561,220; McDade U.S. Pat. No. 4,751,798; and Lehane U.S. Pat. No. 5,637,029, all of which are incorporated herein by reference.

The slurry is discharged from the impellers at a low wheel velocity, preferably below 200 feet per second. In the prior art, most shot blasting is done at speeds greater than 200 feet per second, and as high as 500 feet per second. In the apparatus of the invention, by slurry blasting at a low velocity, the apparatus of the invention is capable of producing a good commercially acceptable RA (i.e., roughness) and not embed scale or grit particles into the softer steel surface. However, because the low wheel velocity for propelling the slurry is desired in the apparatus, the strip processing speed of the apparatus will be reduced. For this reason, an angular grit that more aggressively and more efficiently removes the scale oxide from the strip is preferred. By propelling the slurry at velocities below 200 feet per second, the angular grit will not fracture to a significant extent, and actually rounds up in configuration. This has lead to the preferred use of a much less expensive carbon grit at a much larger grit size which is discharged in the slurry at the low velocity. The rounding of the carbon grit that occurs in the descaling process results in some of the grit being smaller. The smaller grit is needed to ensure surface coverage of the sheet 16. The use of the less expensive carbon grit combines the larger aggressive angular grit to cut through scale and the worn, rounded smaller grit that provides surface coverage. In variant embodiments of the invention, the electric motors 64 can rotate the descaler wheel 68 in the first cell 26 shown to the left in FIG. 1 at a faster speed than the descaler wheels in the second cell 26 shown to the right of FIG. 1. The slurry discharged from the first cell 26 will impact the material 16 with a greater force and remove substantially all of the scale from the surfaces of the material. The slurry discharged from the second cell 26 will impact the material 16 at a reduced force and will generate smoother surfaces on the opposite sides of the material 16. Furthermore, the grit employed in the slurry discharged from each of the cells 26 can be of different sizes. A larger grit in the slurry discharged from the first cell 26 would impact the surfaces of the material 16 to substantially remove all of the scale from the surfaces of the material. A smaller grit in the slurry discharged from the second cell 26 will impact the surfaces of the material 16 to generate smooth surfaces on the opposite sides of the material. A slurry of water and #20 conditioned cut wire shot can used in the first descaler cell, to optimize scale removal from hot rolled carbon steel strip. The resulting surface texture is adjusted by using a range of softer stainless steel shot in the second descaler cell. A blend of #30 and # 10 shot has proven satisfactory. Corrosion inhibitors, for example those marketed under the trademark "Oakite" by Oakite Products, Inc., can be added to the liquid if the product is not to be oiled after processing. The specific products being selected is based on the subsequent use of the sheet being processed and the level of protection required.

The use of stainless steel particles in the slurry can improve the corrosion behavior of the sheet metal. This is reportedly due to a reduction in the free iron ions on the surface of the metal, resulting in some surface passivation. The stainless steel particles mixed with the liquid of the slurry will also not corrode. However, the use of stainless steel particles is expensive. For example, stainless steel grit costs approximately $1.70/pound.

A less expensive alternative to stainless steel grit in the slurry is the use of carbon grit in the slurry. Carbon grit costs approximately $0.42/pound. In addition, an additive can be added to the carbon grit slurry to prevent the carbon grit from corroding. An example of such a rust preventative is the Pro-Tech rust preventative produced by the Nalco Company of Naperville, Ill.

An even more inexpensive particle that can be used in the slurry and not corrode is coal slag particles. Coal slag costs approximately $0.015/pound or 1½ cents per pound. One example of an acceptable coal slag particle is provided under the trade name BLACK MAGNUM by Fairmont Minerals of Charldon, Ohio.

If the incoming material has any oil on the surface, commercial alkaline or other cleaning or degreasing agents can be added to the water of the slurry without changing the efficiency of the slurry blasting process. Other abrasive media can be selected for use by those skilled in the art. The average size, the size distribution, the shape, and the material of the abrasive materials to be blended into the slurry mix depend on the material of the strip being processed, and on the desired surface finish/condition.

Rotation of the electric motor shafts 66 rotates the descaling wheels 68 connected to the shafts. Although the electric motors 62 are the preferred motive source for the descaling wheels 68, other means of rotating the descaling wheels 68 may be employed.

A second pair of centrifugal slurry impellers 88 is mounted to bottom wall panels 44 of the descaler box 28. The units will be identical in basic function and size to the top pair.

Figure 6:
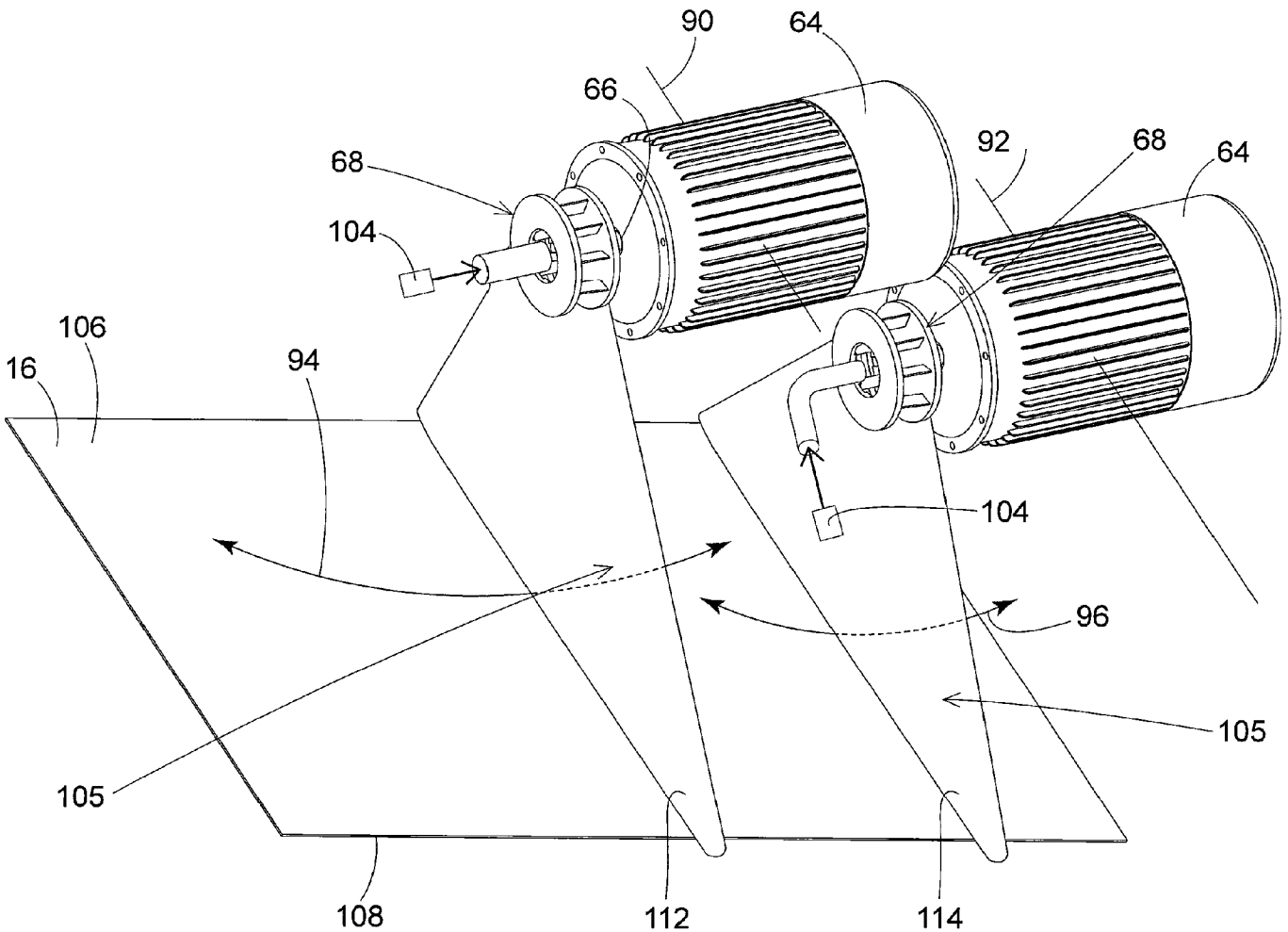
FIG. 6 is a representation of a portion of the descaler shown in FIGS. 4 and 5.

Both the axes 78, 82 of first pair of impellers 68 and the axes 98, 102 of the second pair 88, and their assemblies are mounted to the descaler box 28 oriented at an angle relative to the direction of the length of sheet metal 16 passing through the descaler box 28. The axes 98, 102 of the second pair of motors 84 are also oriented at an angle relative to the plane of the length of sheet metal 16 passing through the descaler cell 28. This angle is selected to ensure a stable flow of slurry, to reduce interference between rebounding particles and those that have not yet impacted the strip surface, and to improve the scouring action of the abrasive, to improve effectiveness of material removal, and to reduce the forces that would tend to embed material into the strip that would have to be removed by subsequent impacts. In a variant embodiment of the apparatus, the pair of motors 84 can be simultaneously adjustably positioned about a pair of axes 90, 92 that are perpendicular to the axes 78, 82 of rotation of the impellers 68 to adjust the angle of impact of the scale removing medium with the surface of the sheet metal 16. This adjustable angle of impact is represented by the curves 94, 96 shown in FIG. 6. Referring to FIG. 1, the axes of rotation of the motors 26 shown in FIG. 1 are oriented at an angle of substantially 20 degrees relative to the surface of the strip 16 moving through the apparatus. In a preferred embodiment, the positions of the motors 26 are adjustable to vary the angle of the slurry blast projected toward the surface of the strip 16 from directly down at the strip surface (i.e., the axes of rotation of the motors 26 being parallel with the surface of the strip 16) to an approximate angle of 60 degrees between the axes of rotation of the motors 26 and the strip surface 16.

A supply of a scale removing medium 104 communicates with the interiors of each of the shrouds 58, 62 in the central portion of the descaling wheels 68 and 84 in the same manner described in the earlier-referenced Lehane Patent, or in an other equivalent manner. The supply of the scale removing medium 104 is shown schematically in FIG. 3 to represent the various known ways of supplying the different types of abrasive slurry removing medium to the interior of the descaler box 28.

The upper pair of descaling wheels 68 propels the scale removing medium 105 downwardly toward the length of sheet metal 16 passing through the descaler cell 28. Using the concepts of the earlier-referenced patents to effectively target the same areas on the strip for the fluid and solid components of the slurry, the propelled scale removing medium 105 impacts with the top surface 106 of the length of sheet metal 16 and removes scale from the top surface. In the preferred embodiment, the each wheel of any pair of descaling wheels will rotate in opposite directions. For example, as the length of sheet metal 16 moves in the downstream direction, if the descaling wheel 68 on the left side of the sheet metal top surface 106 has a counter-clockwise rotation, then the descaling wheel 68 on the right side of the sheet metal top surface 106 has a clockwise rotation. This causes each of the descaling wheels 68 to propel the scale removing medium 105 into contact with the top surface 106 of the length of sheet metal 16, where the contact area of the scale removing medium 105 propelled by each of the descaling wheels 68 extends entirely across, and slightly beyond the width of the length of sheet metal 16. Allowing the discharge to extend slightly beyond the edges of the strip ensures the most uniform coverage. This is depicted by the two almost rectangular areas of impact 112, 114 of the scale removing medium 105 with the top surface of the length of sheet metal 16 shown in FIGS. 6 and 7. Because the direction of travel of the slurry propelled by wheels relative to the strip width direction varies with the discharge position of the slurry across the wheel diameter, there may be some directionality to the resulting texture for positions of slurry impact most distant from the wheel. This is compensated for in this preferred embodiment of invention by the use of pairs of wheels rotating in opposite directions so that each section of the strip is first subjected to the slurry discharge of the first wheel, then any directional effects due to the first discharged slurry are compensated for by the impacts from the second slurry discharged from the second wheel, which will have counter balancing cross strip velocity components to that of the first slurry discharge.

The axially staggered positions of the upper pair of wheels 68 also axially spaces the two impact areas 112, 114 on the surface 106 of the sheet metal. This allows the entire width of the sheet metal to be impacted by the scale removing medium 105 without interfering contact between the medium 105 propelled from each wheel 68. In addition, the pairs of descaling wheels 68 and 84 could be adjustably positioned toward and away from the surface 106 of the sheet metal passing through the descaler. This would provide a secondary adjustment to be used with sheet metal of different widths. By moving the motors 64 and wheel 68 away from the surface 106 of the sheet metal, the widths of the impact areas 112, 114 with the surface 106 of the sheet metal is increased. By moving the motors 64 and their wheels 68 toward the surface 106 of the sheet metal, the widths of the impact areas 112, 114 with the surface 106 of the sheet metal is decreased. This adjustable positioning of the motors 64 and their descaling wheels 68 enables the apparatus to be used to remove scale from different widths of sheet metal. An additional method of width adjustment of the area of slurry impact with the sheet metal surface is to move the angular position of the inlet nozzles 104 relative to the impeller casing/shroud. This is explained in the earlier-referenced patents. A third option is to rotate the pair of impellers about axes 116 normal to their rotation axes relative to the strip travel direction so that the oval area of slurry impact from each wheel, although staying the same length, would not be square or transverse to the strip travel direction. The movement away and toward the strip will change the impact energy of the flow also.

In addition, the angled orientation of the axes 78, 82 of the descaling wheels 68 also causes the impact of the scale removing medium 105 to be directed at an angle relative to the surface of the sheet metal 16. The angle of the impact of the scale removing medium 105 with the surface of the sheet metal 16 is selected to optimize the effectiveness of the scale. An angle of 15 degrees has been proven satisfactory.

In addition, adjusting the characteristics of the scale removing medium 104 can be used to adjust the surface texture of the strip of sheet metal passing through the descaling apparatus. For example, adjusting combinations of the size of the particles, the shape of the particles, or the material of the particles in the slurry of the scale removing medium 104 can produce different desired surface textures on the sheet metal. As stated earlier, the first cells 26 that propel the scale removing medium 104 against the surface of the sheet metal 16 can propel a slurry having a larger grit than the size of the grit in the slurry propelled by the second cells 26. The larger grit would remove substantially all of the scale from the surface of the sheet metal 16. The smaller grit subsequently impacting the surface of the sheet metal 16 would then create a smoother surface on the sheet metal. Alternatively, the rotation speed of the impellor wheels of the first cells 26 to propel the scale removing medium toward the sheet metal 16 could be faster than the rotation speed of the wheels of the second cells 26. This would also result in the scale removing medium propelled by the first cells 26 impacting the surface of the sheet metal 16 to remove substantially all of the scale from the surface. The subsequent impact of the scale removing medium propelled by the slower rotating wheels of the second cells 26 would impact the surface of the sheet metal 16 and create a smoother surface.

Figure 7:
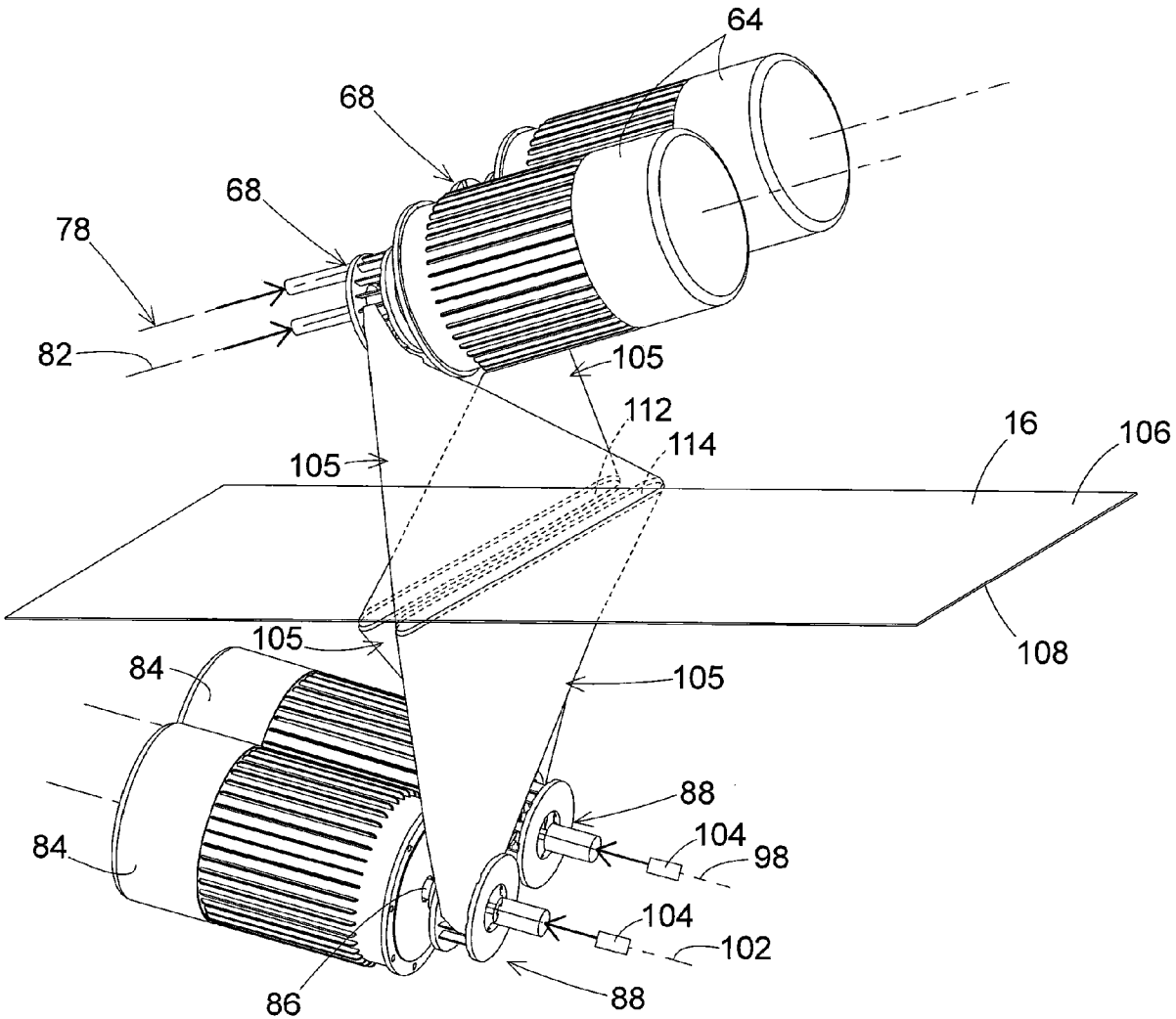
FIG. 7 is a representation of a further portion of the descaler shown in FIGS. 4 and 5.

As shown in FIGS. 3 and 7, the lower pair of descaling wheels 88, direct the scale removing slurry 105 to impact with the bottom surface 108 of the length of sheet metal 16 in the same manner as the top pair of descaling wheels 68. In this configuration the areas of impact of the scale removing medium 105 on the bottom surface 108 of the length of sheet metal 16 is directly opposite the areas of impact 112, 114 on the top surface of the sheet metal. This balances the strip loads from the top and bottom streams of slurry to improve line tension stability. Thus, the bottom descaling wheels 88 function in the same manner as the top descaling wheels 68 to remove scale from the bottom surface 108 of the sheet metal 16 passed through the descaler 26.

In the embodiment of the apparatus processing line shown in FIGS. 1 and 2, two blasting cells 26 are positioned sequentially in the path of the sheet metal 16 passing through the line of the apparatus. An oxide detector could be positioned between the two blasting cells 26 shown in FIG. 1. The oxide detector would detect the level of scale remaining on the strip surface 16 after the surface passes through the first blasting cell 26, and can be used to operate the subsequent blasting cell 26 to effectively remove any remaining scale on the surface of the sheet metal 16. On exiting the two cells 26, the sheet metal 16 can be further conditioned.

A brusher 122 is positioned adjacent the blasting cell 26 to receive the length of sheet metal 16 from the descalers. The brusher 122 could be of the type disclosed in the Voges U.S. Pat. No. 6,814,815, which is incorporated herein by reference. The brusher 122 comprises pluralities of rotating brushes arranged across the width of the sheet metal 16. The rotating brushes contained in the brusher 122 contact the opposite top 106 and bottom 108 surfaces of the length of sheet metal 16 as the sheet metal passes through the brusher 122, and produce a unique brushed and blasted surface, generally with a lower roughness, with some directionality. The brushes act with water sprayed in the brusher 122 to process the opposite surfaces of the sheet metal, adjusting or modifying the texture of the surfaces created by the blasting cells 26. Alternatively, the brusher 122 could be positioned upstream of the blasting cells 26 to receive the length of sheet metal 16 prior to the descalers. In this positioning of the brusher 122, the brusher would reduce the workload on the blasting cells 26 in removing scale from the surfaces of the sheet metal 16. However, it is preferred that the brushers be positioned downstream of the descalers.

A dryer 124 is positioned adjacent the brusher 122 to receive the length of sheet metal 16 from the brusher, or directly from the slurry blaster if the brushing unit is not installed or is deselected. The dryer 124 dries the liquid from the surfaces of the length of sheet metal 16 as the sheet metal passes through the dryer. The liquid is residue from the rinsing process.

A coiler 126 receives the length of sheet metal 16 from the dryer 124 and winds the length of sheet metal into a coil for storage or transportation of the sheet metal.

In alternative line configurations/embodiments, the length of sheet metal processed by the apparatus may be further processed by a coating being applied to the surfaces of the sheet metal, for example a galvanizing coating or a paint coating.

The length of sheet metal could also be further processed by running the length of sheet metal through the line apparatus shown in FIGS. 1 and 2 a second time.

It should also be appreciated that the opposite surfaces of the length of sheet metal could be processed by the apparatus differently, for example by employing different scale removing medium supplied to the wheels above and below the length of sheet metal passed through the apparatus.

The descalers of the apparatus could also be positioned at different positions in a line other than those shown in FIGS. 1 and 2. For example, the descalers could be positioned after the brushers as described earlier.

Figure 8:
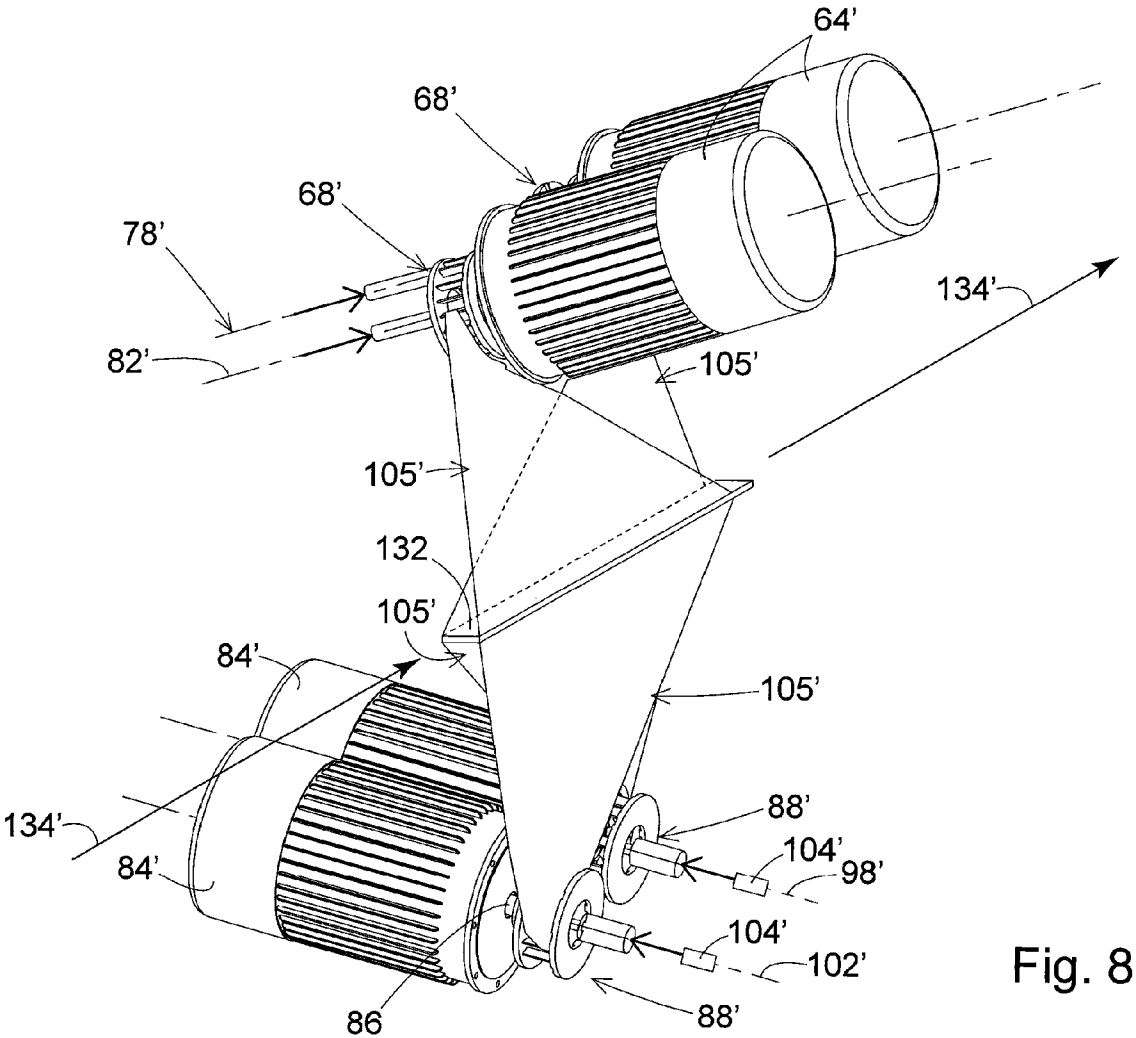
FIG. 8 is a representation of an embodiment of the descaler that removes scale from a narrow, thin strip of material.

The apparatus of the invention may also be employed in removing scale from material that is in an other form than a sheet of material. FIG. 8 depicts the apparatus of the invention employed in removing scale from the exterior surfaces of narrow, thin strip material 132, for example, metal strip that is latter formed into tubing. In the variant embodiment of the apparatus shown in FIG. 8, the same descalers of the previously described embodiments of the invention are employed. The same reference numbers are employed in identifying the component parts and the positional relationships of the previously described embodiments of the invention, but with the reference numbers being followed by a prime (′). In FIG. 8, the length of strip 132 is moved through the descaling apparatus of the invention in the direction indicated by the arrows 134. It can be seen that the orientations of the impellor wheels 68′, 88′ are such that they will propel the scale removing medium 105′ where the width of the contact area of the scale removing medium 105′ extends along the length of the strip 132. Apart from the above-described differences, the embodiment of the apparatus shown in FIG. 8 functions in the same manner as the previously described embodiments of the invention in removing scale from the surface of metal strip 132. Alternatively, the pair of rotating wheels can be adjustably positioned closer to the opposite surfaces of the strip of material so that the widths of the blast zones is just slightly larger than the width of the strip surfaces. In this alternative the speed of the wheels would be decreased slightly to compensate for the increase in the blasting force due to moving the wheels closer to the surfaces.

Figure 9:
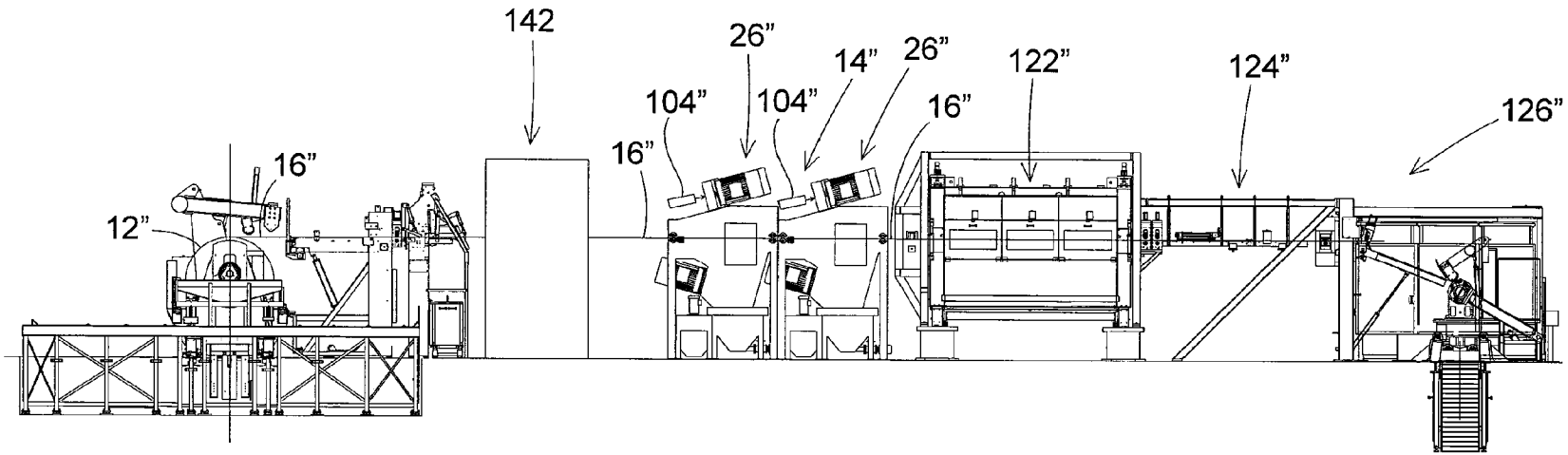
FIG. 9 is a representation of the descaling apparatus employed in a pickling line.

FIG. 9 shows a further embodiment of the apparatus of the invention. In FIG. 9, the descaler cells 26" are positioned downstream of an acid pickling line 142 represented schematically in FIG. 9. The remaining component parts of the apparatus are the same as those of the earlier-described embodiment, with the reference numbers identifying the component parts being followed by a double prime (″). In the embodiment shown in FIG. 9, a length of sheet metal 16" is first pickled by the acid pickling line 142. The descaling cells 26" are positioned to receive the length of sheet metal 16" that is exiting the acid pickling line 142. A disadvantage in acid pickling sheet metal to remove scale is that the pickling process often does not completely remove the phenomena known as "black edge." This is the scale built up along the portions of the opposite surfaces of the sheet metal along the edges of the length of sheet metal 16". In the embodiment of the invention shown in FIG. 9, the descaling cells 26" are positioned to direct scale removing medium toward the opposite surfaces along the side edges of the length of sheet metal 16" that pass between the cells. The scale removing medium impacting along the portions of the opposite surfaces along the side edges of the length of sheet metal 16" is targeted toward and removes the black edges from both sides of the sheet metal 16" that passes between the cells.

The descaler apparatus described above provides a means of substantially removing all scale from processed sheet metal (i.e., sheet metal that has been previously hot rolled or otherwise processed), tubular metal, and previously pickled sheet metal.

Although the apparatus and the method of the invention have been described herein by referring to several embodiments of the invention, it should be understood that variations and modifications could be made to the basic concept of the invention without departing from the intended scope of the following claims.

The invention claimed is:

1. A method of removing scale from a length of sheet metal comprising:

acid pickling the length of sheet metal;

propelling a scale removing medium against one edge of the length of sheet metal; and, propelling the scale removing medium against an opposite edge of the length of sheet metal;

wherein the step of propelling a scale removing medium against one edge of the length of the sheet metal comprises:

positioning a first wheel having a first axis of rotation adjacent a first surface of the length of sheet metal;

supplying the scale removing medium to the first wheel;

rotating the first wheel about the first axis of rotation whereby the scale removing medium supplied to the first wheel is propelled by the rotating first wheel against a first area extending across substantially an entire width of the first surface of the length of sheet metal; and wherein the step of propelling a scale removing medium against an opposite edge of the length of the sheet metal comprises:

positioning a second wheel having a second axis of rotation adjacent the first surface of the length of sheet metal;

supplying the scale removing medium to the second wheel;

rotating the second wheel about the second rotation axis whereby the scale removing medium supplied to the second wheel is propelled by the rotating second wheel against a second area extending across substantially the entire width of the first surface of the length of sheet metal; and wherein the first wheel and the second wheel are positioned relative to the length of sheet metal where the first wheel is spaced from the second wheel along the length of sheet metal such that the scale removing medium propelled from the second wheel does not substantially interfere with the scale removing medium propelled from the first wheel;

wherein the first wheel and the second wheel are rotated in opposite directions;

wherein the first wheel and the second wheel are positioned along adjacent opposite side edges defining the width of the sheet metal with the sheet metal centered between the first wheel and the second wheel;

wherein the rate of slurry impact in the first and second impact areas adjacent the first and second longitudinal edges is controlled to substantially improve the surface condition thereof; and wherein acid pickling the length of sheet metal and propelling the scale removing medium against the longitudinal edges of the sheet metal substantially removes the scale from the sheet metal.

2. The method of claim 1, further comprising:

angularly adjustably positioning the first axis of rotation and the second axis of rotation relative to the first surface of the length of sheet metal.

3. The method of claim 1, further comprising:

adjustably positioning the first axis of rotation and the second axis of rotation toward and away from the length of sheet metal.

4. The method of claim 1, further comprising:

brushing the first surface of the length of sheet metal after propelling the scale removing medium against the first surface.

5. The method of claim 1 further comprising:

propelling a scale removing medium against one edge of the length of sheet metal on a second surface of the sheet metal opposite the first surface of the sheet metal being acted upon by the first and second wheels; and propelling the scale removing medium against an opposite edge of the length of sheet metal on the second surface of the sheet metal;

wherein the step of propelling a scale removing medium against one edge of the length of the sheet metal on the second surface comprises:

positioning a third wheel having a third axis of rotation adjacent a second first surface of the length of sheet metal;

supplying the scale removing medium to the third wheel;

rotating the third wheel about the third axis of rotation whereby the scale removing medium supplied to the third wheel is propelled by the rotating the third wheel against a third area extending across substantially an entire width of the second surface of the length of sheet metal; and wherein the step of propelling a scale removing medium against an opposite edge of the length of the sheet metal second surface comprises:

positioning a fourth wheel having a fourth axis of rotation adjacent the second surface of the length of sheet metal;

supplying the scale removing medium to the fourth wheel;

rotating the fourth wheel about the fourth rotation axis whereby the scale removing medium supplied to the fourth wheel is propelled by the rotating fourth wheel against a fourth area extending across substantially the entire width of the second surface of the length of sheet metal; and wherein the third wheel and the fourth wheel are positioned relative to the length of sheet metal where the third wheel is spaced from the fourth wheel along the length of sheet metal such that the scale removing medium propelled from the fourth wheel does not substantially interfere with the scale removing medium propelled from the third wheel;

wherein the third wheel and the fourth wheel are rotated in opposite directions;

wherein the third wheel and the fourth wheel are positioned along adjacent opposite side edges defining the width of the sheet metal with the sheet metal centered between the third wheel and the fourth wheel; and wherein the rate of slurry impact in the third and fourth impact areas adjacent the third and fourth longitudinal edges is controlled to substantially improve the surface condition thereof.

6. The method of claim 5, further comprising:

adjustably positioning the third axis of rotation and the fourth axis of rotation toward and away from the length of sheet metal.

7. The method of claim 5, further comprising:

brushing the second surface of the length of sheet metal after propelling the scale removing medium against the second surface.

8. The method of claim 5, further comprising:

angularly adjustably positioning the third axis of rotation and the fourth axis of rotation relative to the second surface of the length of sheet metal.

9. The method of claim 1, wherein:

acid pickling the length of sheet metal occurs after descaling.

* * * * *